US007077150B2

(12) United States Patent
McNerney

(10) Patent No.: US 7,077,150 B2
(45) Date of Patent: Jul. 18, 2006

(54) SCREWLESS TUB/SHOWER TRIM MOUNTING SYSTEM

(75) Inventor: Gerald J. McNerney, Carmel, IN (US)

(73) Assignee: Delta Faucet Company, Indianapolis, IN (US)

( * ) Notice: Subject to any disclaimer, the term of this patent is extended or adjusted under 35 U.S.C. 154(b) by 406 days.

(21) Appl. No.: 10/606,730

(22) Filed: Jun. 26, 2003

(65) Prior Publication Data

US 2004/0261852 A1 Dec. 30, 2004

(51) Int. Cl.
*F16L 5/00* (2006.01)

(52) U.S. Cl. ..... 137/15.01; 137/315.01; 137/359; 4/676

(58) Field of Classification Search ..... 137/359, 137/15.01; 4/675, 676
See application file for complete search history.

(56) References Cited

U.S. PATENT DOCUMENTS

| | | | | | |
|---|---|---|---|---|---|
| D87,830 | S | | 9/1932 | Ferguson | |
| 2,896,222 | A | | 7/1959 | Freibott | |
| 3,014,492 | A | * | 12/1961 | Young | 137/271 |
| 3,026,898 | A | | 3/1962 | Weller | |
| 3,029,831 | A | * | 4/1962 | Leete | 137/360 |
| 3,043,330 | A | | 7/1962 | Young | |
| D193,756 | S | | 10/1962 | Parker | |
| D194,229 | S | | 12/1962 | Landell | |
| 3,067,436 | A | * | 12/1962 | Freibott | 4/675 |
| 3,117,588 | A | * | 1/1964 | Billeter | 137/359 |
| 3,118,464 | A | | 1/1964 | McClenahan | |
| D203,795 | S | | 2/1966 | Harvey | |
| 3,275,036 | A | | 9/1966 | Spencer | |
| 3,329,162 | A | | 7/1967 | Sanford | |
| 3,331,386 | A | | 7/1967 | Politz | |
| 3,376,888 | A | * | 4/1968 | Anthony | 137/359 |
| 3,411,541 | A | | 11/1968 | Hindman | |
| D231,054 | S | | 4/1974 | Sahloff | |
| D231,055 | S | | 4/1974 | Sahloff | |
| D241,440 | S | | 9/1976 | Doman | |
| 4,240,462 | A | | 12/1980 | Bankstahl | |
| D263,989 | S | | 4/1982 | Fleischmann | |
| D284,687 | S | | 7/1986 | Doman | |
| D285,107 | S | | 8/1986 | Ogilvie | |
| D285,108 | S | | 8/1986 | Ogilvie | |
| D285,245 | S | | 8/1986 | Ogilvie | |
| 4,662,389 | A | * | 5/1987 | Igbal | 137/359 |
| 4,794,945 | A | | 1/1989 | Reback | |

(Continued)

FOREIGN PATENT DOCUMENTS

DE 30 09 599 9/1981

(Continued)

OTHER PUBLICATIONS

International Search Report dated Sep. 23, 2004.

*Primary Examiner*—A. Michael Chambers
(74) *Attorney, Agent, or Firm*—Carlson, Gaskey & Olds

(57) ABSTRACT

A valve assembly includes an escutcheon that is secured to a valve housing by a threaded adapter. Thus, no screws need extend through the escutcheon, resulting in a more visually pleasing outer appearance. Further, a trim sleeve may be inserted into the escutcheon adapter to turn the escutcheon adapter relative to the valve housing and adjust the position of the escutcheon tightly against the wall. The present invention thus provides an escutcheon which need not have any screws to secure it to the fixed structure, but which is securely held to the valve housing.

13 Claims, 4 Drawing Sheets

U.S. PATENT DOCUMENTS

| | | | | |
|---|---|---|---|---|
| D300,238 | S | 3/1989 | Kohler | |
| D303,566 | S | 9/1989 | Kohler | |
| 4,989,633 | A | 2/1991 | Humpert | |
| D319,294 | S | 8/1991 | Kohler | |
| D321,468 | S | 11/1991 | Reid | |
| D322,926 | S | 1/1992 | Kolada | |
| D331,797 | S | 12/1992 | Rosenbaum | |
| D332,826 | S | 1/1993 | Rosenbaum | |
| 5,257,645 | A | 11/1993 | Scully | |
| D345,004 | S | 3/1994 | Bengtson | |
| D345,782 | S | 4/1994 | Short | |
| D355,021 | S | 1/1995 | Schott | |
| 5,447,338 | A | 9/1995 | Kikuchi | |
| 6,419,276 | B1 | 7/2002 | Gatter et al. | |
| 6,807,983 | B1 * | 10/2004 | Erickson | 137/359 |

FOREIGN PATENT DOCUMENTS

| | | |
|---|---|---|
| EP | 0 854 243 | 7/1998 |

* cited by examiner

SCREWLESS TUB/SHOWER TRIM MOUNTING SYSTEM

BACKGROUND OF THE INVENTION

This invention relates to a system wherein the components providing the covering trim for a bath/shower valve are attached and adjustable without the use of screws.

Typically, bath or shower surrounds are provided with at least one mixing valve and a diverter valve. The mixing valve is utilized to control the mixture of hot and cold water which is delivered into the tub or from the shower. The diverter valve typically controls the flow of water to either the shower or the bath spout.

In the past, a cover member, called an escutcheon, covers the valve and provides the outermost trim member. Typically, an inner valve housing within the wall is provided with a mounting bracket. The mounting bracket receives screws from the escutcheon. While screws can be made to be attractive or decorative, the screws themselves may still detract from the desired overall outer appearance.

Various systems have been proposed wherein the escutcheon simply is received on an outer peripheral surface of a valve member. However, these systems have not provided a way for tightly securing the escutcheon to the valve assembly and against the wall.

Further, in many of the known valve trim systems, the escutcheon provides the function of securing the valve within its housing. Thus, the escutcheon needs to be placed upon the wall at a relatively early point in the construction of the bath or shower surround. Since the escutcheon is thus attached during a good deal of construction, there is the possibility of damage to the escutcheon.

The proposed invention includes an escutcheon that can be attached to a valve assembly without any screws, and wherein the valve is secured within its housing by a member which would not ultimately be exposed.

SUMMARY OF THE INVENTION

In the disclosed embodiment of this invention, the escutcheon is attached to an adjustment adapter. The adapter is adjustable to pull the escutcheon tightly against the wall creating the bath or shower surround. This adjustment can be done after completion of other construction on the bath or shower surround. Further, the adapter itself is not attached to the valve housing through screws, but rather through an enlarged threaded surface.

Thus, no screws are required. Further, the escutcheon can be attached and ultimately adjusted after the completion of other construction.

In a more preferred embodiment of this invention, an adjustment member can extend into the adapter such that the adapter may be turned after attachment of the escutcheon and complete assembly. The adapter is thus turned relative to the valve housing to pull the escutcheon against the wall, and adjust for the particular size of the wall.

These and other features of the present invention can be best understood from the following specification and drawings, the following of which is a brief description.

DETAILED DESCRIPTION OF THE PREFERRED EMBODIMENT

Figure 1A:
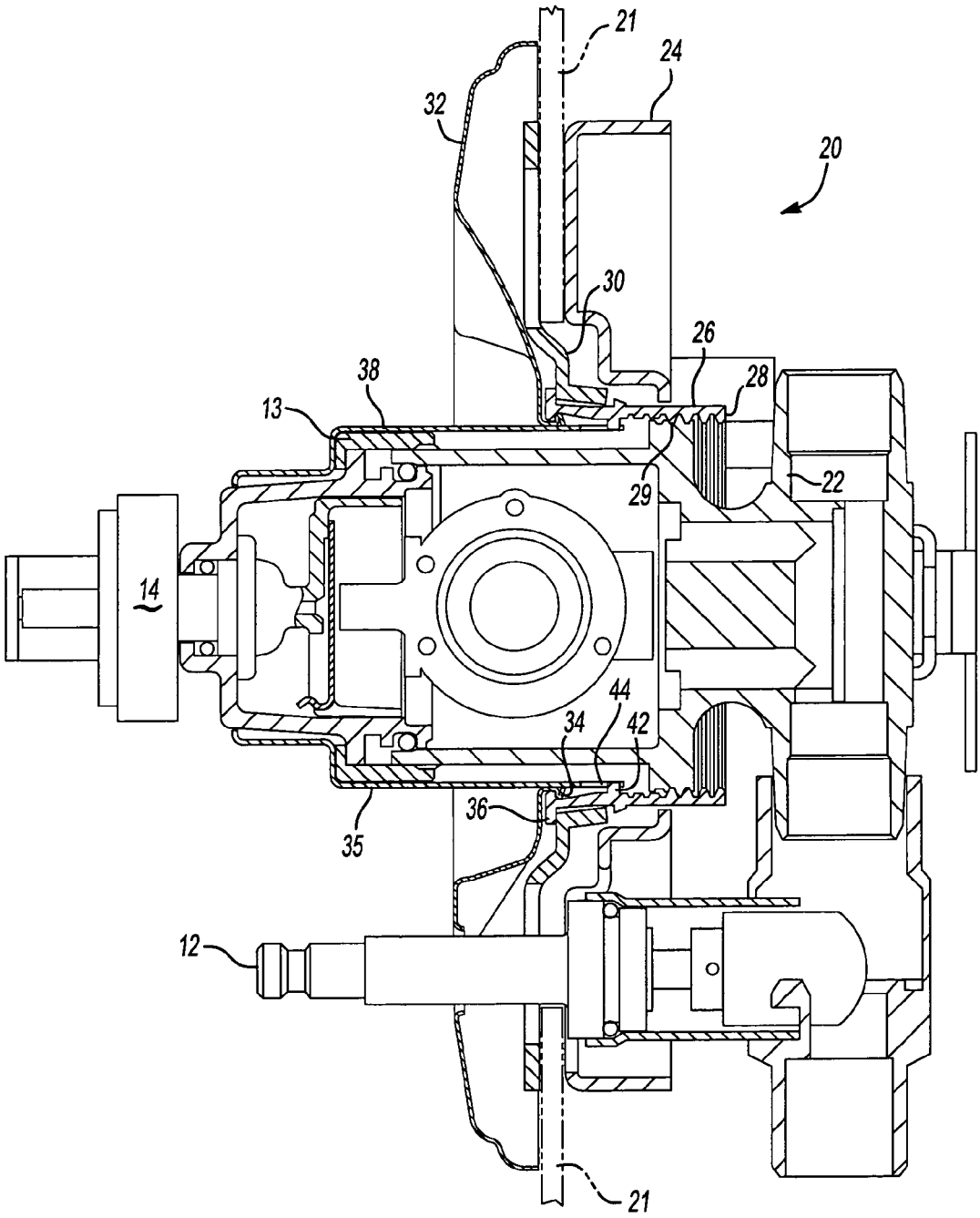
FIG. 1A is a cross-sectional view of the inventive system.

FIG. 1A shows a valve assembly 20 for attachment into a wall 21 forming a bath and shower surround. One main component is a bracket 121 (FIG. 2) secured to the valve housing 22. In the past, this bracket was utilized to secure the great bulk of the members shown in this view. Typically, the components were screwed to the bracket 121. A plaster guard member 24 is received on the housing, and provides an abutting inner surface for the contacting the wall 21.

An escutcheon adapter 26 forms one of the inventive aspects of this invention. As shown, escutcheon adapter 26 has threads 28 at an inner surface received on threads 29 on the valve housing 22. This threaded connection allows adjustment of the adapter, and as will be explained, the escutcheon without the need for any screws being visible from outward of the final valve assembly 20.

A plate 30 is received on the outer periphery of the adapter 26, and the escutcheon 32 is positioned outwardly of the plate 30. Escutcheon 32 includes a lip 34 on an axially inwardly extending boss 35. Lip 34 snaps within a groove 36 at an outward end of the adapter 26. A trim sleeve forms an adjustment element 38. Element 38 has a groove 44 fitting onto a tab 42 on the inner peripheral surface of the adapter 26.

Figure 1C:
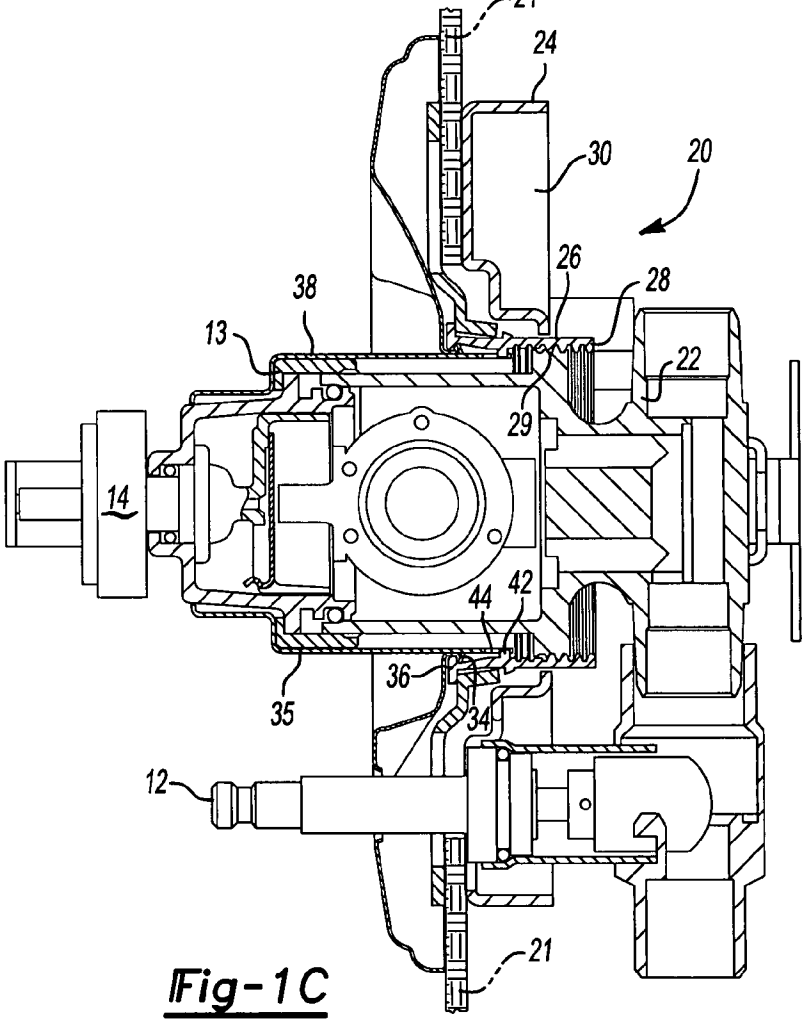
FIG. 1C shows the inventive system adjusted for a thinner wall.
Figure 1B:
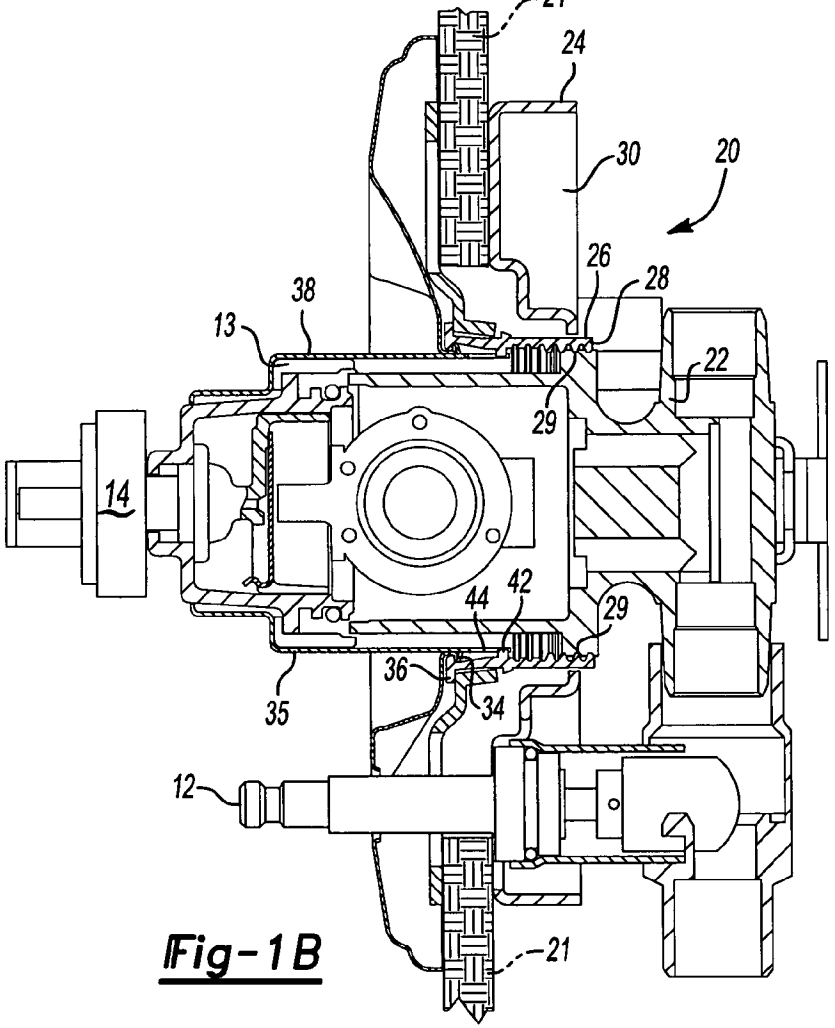
FIG. 1B shows the inventive system attached to a relatively thick wall.

As shown in FIG. 1B, wall 21 is relatively thick. If one looks at the relative position of the threaded connections between threads 28 and 29, and compares it to the position in FIG. 1C showing a thin wall, one can appreciate the adjustability of the inventive system. However, the point is that the invention allows adjustment. Essentially, after assembly of the valve, the element 38 is turned to drive the adapter 26 along the housing 22. During this movement, the escutcheon 32 is pulled inwardly until it sits snug against the wall 21. As can be appreciated, the escutcheon adapter 26 is inward of the wall, and engages threads on an opposed side of the wall from the surface against which the escutcheon abuts. At that point, the element 38 forms a trim sleeve for the valve 14, shown schematically in FIG. 1A. Thus, the escutcheon is tightly secured against the wall, but still has an aesthetically pleasing outer appearance.

As can further be appreciated in FIG. 1A, a locking nut 13 is held on housing 22. As further can be appreciated from FIG. 1A the diverter valve 12 is held within the housing via a threaded connection. Notably, this invention extends to valve assemblies without a diverter valve.

Figure 2:
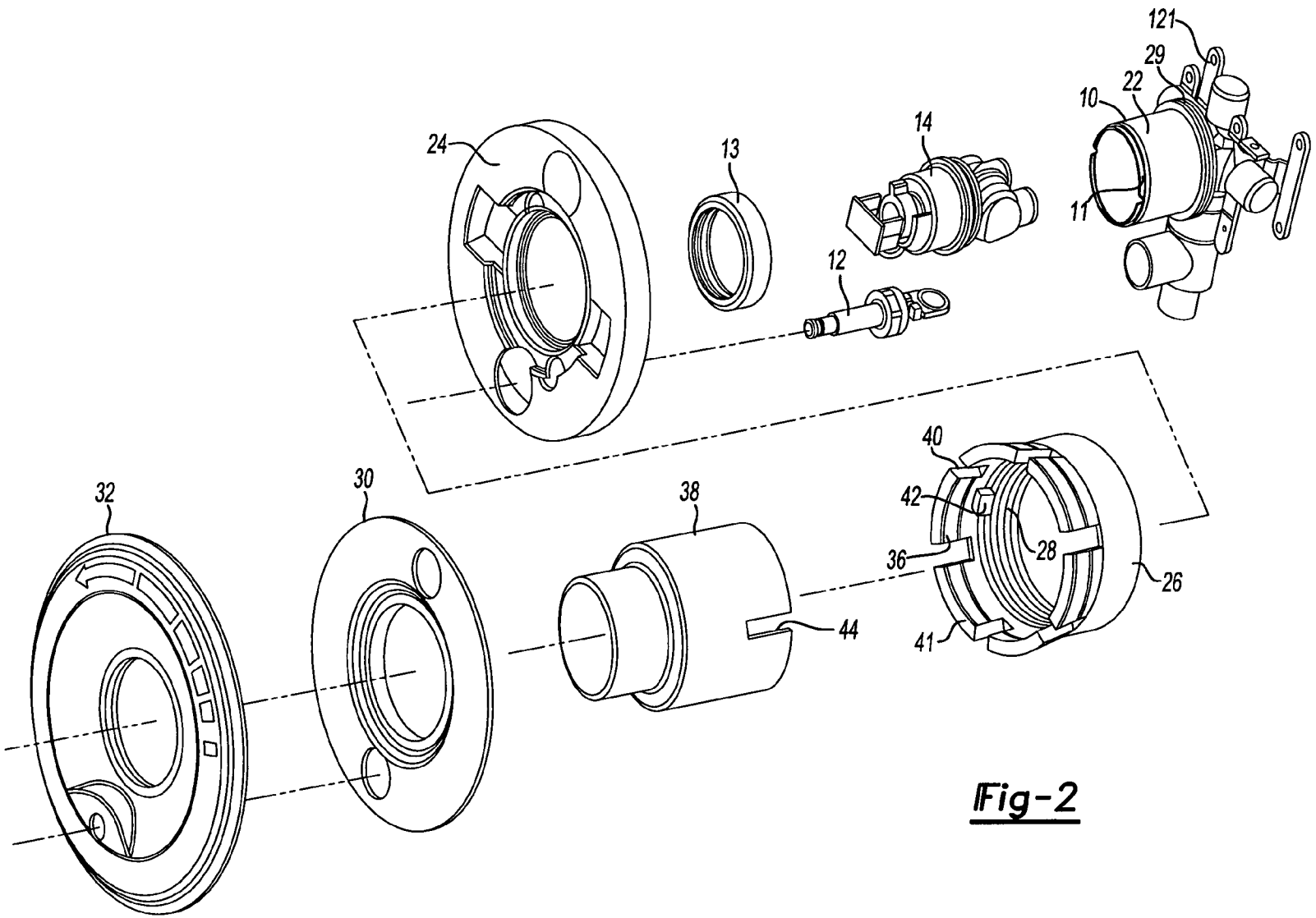
FIG. 2 is an exploded view of the inventive system.

As can be appreciated from FIG. 2, the housing 22 includes the bracket 121 and the threads 29 on a boss portion 10. The valve 14 is received within an opening in the housing as is the diverter valve 12. The locking ring 13 is screwed onto threads 11 at an outer end of the housing 22.

The plaster guard 24 sits radially spaced from outer boss 10 of the housing 20.

The adapter 26 includes the tab 42 and the threads 28. As can be appreciated from this figure, the outer end of the adapter 26 has a plurality of gaps 40 between circumferentially spaced portions 41. These portions 41 provide the groove 36.

The trim sleeve 38 carries a slot 44, and the plate 30 and escutcheon 32 are positioned outwardly of the adapter as can be appreciated from FIGS. 1A–1C.

Figure 3:
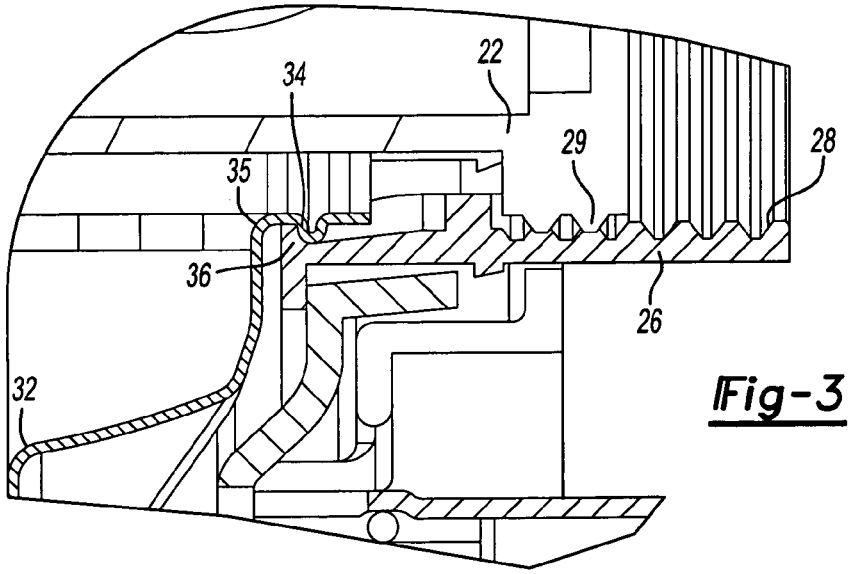
FIG. 3 shows a detail of the attachment of the escutcheon to its adapter.
Figure 4:
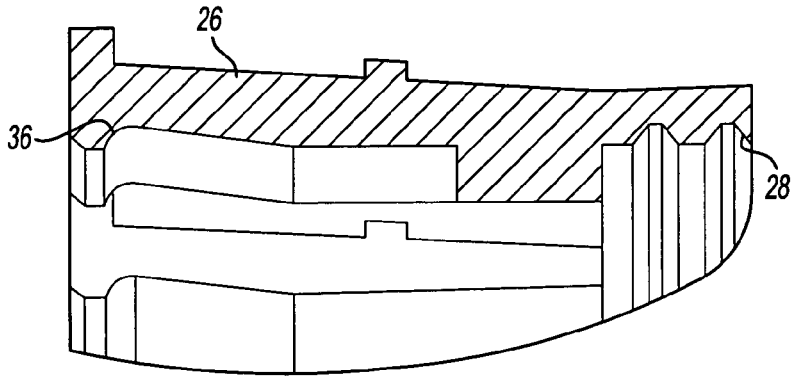
FIG. 4 shows a detail of the adapter.

FIG. 3 shows features of the adapter 26 received on threads 29 of the housing 22. The lip 34 is received within the groove 36 to hold and carry the escutcheon 32 when the adapter is driven. The groove 36 and the threads 28 can be better seen in FIG. 4.

Figure 5:
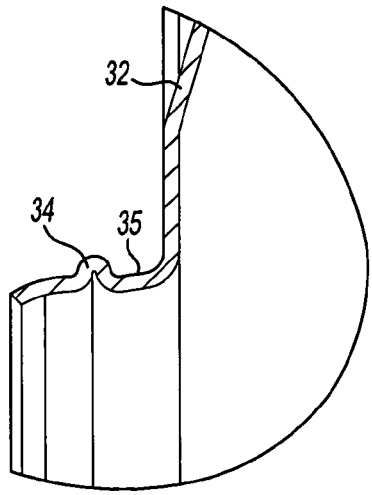
FIG. 5 shows a detail of the escutcheon.

FIG. 5 shows the lip 34 on the inwardly extending neck 35 of the escutcheon 32.

Although preferred embodiments of this invention have been disclosed, a worker of ordinary skill in the art would recognize that certain modifications would come within the scope of this invention. For that reason, the following claims should be studied to determine the true scope and content of this invention.

What is claimed is:

1. A method of assembling a mixing valve assembly comprising the steps of:

(1) providing a valve housing, an escutcheon and an escutcheon adapter;

(2) mounting said valve housing within a wall, and securing said escutcheon to move with said escutcheon adapter; and (3) moving said escutcheon adapter inwardly of said wall and relative to said housing to in turn pull said escutcheon and secure said escutcheon against an outer surface of the wall.

2. A method as set forth in claim 1, wherein a trim sleeve surrounds a valve mounted within said valve housing, said trim sleeve having an interconnection with said escutcheon adapter and said trim sleeve extending axially outwardly beyond said escutcheon such that said trim sleeve is accessible to be turned to turn said escutcheon adapter and provide said movement of said step (3).

3. A valve assembly comprising:

a valve housing for receiving a mixing valve;

a mixing valve received within said valve housing;

an escutcheon to be positioned axially outwardly of said valve housing to define an outer surface of said valve assembly; and an escutcheon adapter secured to said escutcheon, said escutcheon adapter adjustable inwardly and outwardly relative to said housing to pull said escutcheon with said escutcheon adapter and allow adjustment and provide securement of said escutcheon, said escutcheon adapter being adjustable on structure that will be spaced towards an opposed side of a wall that will receive the valve assembly from a side of the wall against which the escutcheon will abut.

4. A valve assembly as set forth in claim 3, wherein said escutcheon adapter is threadably received on a fixed member such that it may be adjusted to pull said escutcheon to an adjusted position.

5. A valve assembly as set forth in claim 4, wherein a threaded connection is provided between a threaded surface on said valve housing and a threaded surface on said escutcheon adapter.

6. A valve assembly as set forth in claim 5, wherein said valve housing has an outer threaded surface and said escutcheon adapter has an inner peripheral threaded surface.

7. A valve assembly comprising:

a valve housing for receiving a mixing valve;

a mixing valve received within said valve housing;

an escutcheon to be positioned axially outwardly of said valve housing to define an outer surface of said valve assembly;

an escutcheon adapter secured to said escutcheon, said escutcheon adapter adjustable inwardly and outwardly relative to said housing to pull said escutcheon with said escutcheon adapter and allow adjustment and provide securement of said escutcheon, said escutcheon adapter is threadably received on a fixed member such that it may be adjusted to pull said escutcheon to an adjusted position:

a threaded connection provided between a threaded surface on said valve housing and a threaded surface on said escutcheon adapter, said valve housing has an outer threaded surface and said escutcheon adapter has an inner peripheral threaded surface; and a trim sleeve inserted into an inner peripheral surface on said escutcheon adapter, and operable to turn said escutcheon adapter to provide said adjustment on said threads.

8. A valve assembly as set forth in claim 7, wherein said trim sleeve has a slot and tab interconnection with said escutcheon adapter.

9. A valve assembly as set forth in claim 8, wherein said trim sleeve has said slot and said escutcheon adapter has said tab.

10. A valve assembly comprising:

a valve housing for receiving a mixing valve;

a mixing valve received within said valve housing;

an escutcheon to be positioned axially outwardly of said valve housing to define an outer surface of said valve assembly; and an escutcheon adapter secured to said escutcheon, said escutcheon adapter adjustable inwardly and outwardly relative to said housing to pull said escutcheon with said escutcheon adapter and allow adjustment and provide securement of said escutcheon, said escutcheon has a tab which snaps into a groove in said escutcheon adapter.

11. A valve assembly comprising:

a valve housing for receiving a mixing valve;

a mixing valve received within said valve housing;

an escutcheon to be positioned axially outwardly of said valve housing to define an outer surface of said valve assembly;

an escutcheon adapter secured to said escutcheon, said escutcheon adapter adjustable inwardly and outwardly relative to said housing to pull said escutcheon with said escutcheon adapter and allow adjustment and provide securement of said escutcheon; and said escutcheon adapter having a threaded inner peripheral surface, and said valve housing having a cylindrical boss with an outer threaded surface, said escutcheon adapter inner peripheral threaded surface being threadably received on said valve housing outer threaded surface, a trim sleeve surrounding said mixing valve and extending into said inner peripheral surface of said escutcheon adapter, and having a portion extending axially outwardly beyond said escutcheon, said trim sleeve having a slot and tab interconnection with said escutcheon adapter such that said trim sleeve can be turned to turn said escutcheon adapter and provide adjustment for said escutcheon.

12. A valve assembly as set forth in claim 11, wherein said trim sleeve has said slot and said escutcheon adapter has said tab.

13. A valve assembly as set forth in claim 11, wherein said escutcheon has a tab which snaps into a groove in said escutcheon adapter.

* * * * *

UNITED STATES PATENT AND TRADEMARK OFFICE

CERTIFICATE OF CORRECTION

PATENT NO. : 7,077,150 B2
APPLICATION NO. : 10/606730
DATED : July 18, 2006
INVENTOR(S) : Gerald J. McNerney It is certified that error appears in the above-identified patent and that said Letters Patent is hereby corrected as shown below:

Column 3, Line 26:

Please add the following before "and secure":

--against an outer wall surface as said escutcheon adapter moves beyond an inner wall surface--

Signed and Sealed this

Twenty-eighth Day of November, 2006

JON W. DUDAS
*Director of the United States Patent and Trademark Office*